United States Patent [19]

Stiasny

[11] 4,153,035

[45] May 8, 1979

[54] FLAME BREAKER FOR INDUSTRIAL FURNACE HEATING ELEMENT

[75] Inventor: Carl-Heinz Stiasny, Bruneck, Italy

[73] Assignee: Birfield Trasmissioni S.p.A., Bruneck, Italy

[21] Appl. No.: 826,232

[22] Filed: Aug. 19, 1977

[30] Foreign Application Priority Data

Aug. 24, 1976 [IT] Italy ..... 26469 A/76

[51] Int. Cl.[2] ..... F27B 5/14

[52] U.S. Cl. ..... 126/91 A; 432/102; 432/209

[58] Field of Search ..... 126/91 A, 91 R; 110/326; 432/209, 102

[56] References Cited

U.S. PATENT DOCUMENTS

| | | | |
|---|---|---|---|
| 665,658 | 1/1901 | Jankus | 110/326 |
| 2,226,816 | 12/1940 | Hepburn | 126/91 A |
| 2,410,881 | 11/1946 | Hunter | 126/91 A |
| 2,822,798 | 2/1958 | Ipsen | 126/91 A |
| 3,180,322 | 4/1965 | Gibbard | 110/326 |
| 3,920,383 | 11/1975 | Kerr | 432/175 |

*Primary Examiner*—Carroll B. Dority, Jr.
*Attorney, Agent, or Firm*—Toren, McGeady and Stanger

[57] ABSTRACT

In a generally elongated tubular burner heating element for the furnace chamber of an industrial furnace there is provided within the heating element at an end thereof opposite the end at which the burner is located a flame breaker assembly arranged to extend along the length of the burner heating element comprising a plurality of generally circular baffle plates spaced axially along the heating element and arranged basically in three groups. The first group of baffle plates which may comprise one or more plates and which is arranged closest to the burner comprises convex discs with their convex side directed toward the burner. The second group intermediate the first and the third group comprises a plurality of generally planer discs while the third group comprises concave discs having their concave side facing toward the burner. Each group of baffle plates may be provided to extend within a predetermined range of the length of the heating element and the baffle plate diameters of each group may all be identical or the diameters of all the plates may progressively increase from the plate nearest the burner to the plate furthest therefrom.

28 Claims, 5 Drawing Figures

14
5
13
1
15
3
2
18
16
17
6
4
11
8
9
7
10
12

FLAME BREAKER FOR INDUSTRIAL FURNACE HEATING ELEMENT

BACKGROUND OF THE INVENTION

The present invention relates to the construction of industrial furnaces and is more particularly concerned with the structure of heating elements for such furnaces. More particularly, the invention is directed toward the structure and arrangement of a flame breaker assembly for a tubular elongated heating element of an industrial furnace.

Heating elements of the type to which the present invention relate generally comprise a burner located at one end thereof and a tubular elongated heating element or jet pipe which passes through or in close proximity to the furnace chamber and which has the burner located at one end thereof. Arranged at the opposite end of the jet pipe is a flame breaker which extends from the end of the jet pipe remote from the burner.

In such known heating devices, a flame breaker may consist of several coupled sectors which impart a helical path for gas flowing through the jet pipe or heating element. Such flame breakers may be made of ceramic material. With a design of this type, heat losses which are generated may be relatively high and thus there occurs rather high energy consumption. Furthermore, flame breaker designs of the type mentioned may involve the risk of breakage particularly where vibrations in the furnace occur which may be caused, for example, by imbalances in the blower means provided in the furnace for circulating the furnace atmosphere.

The risk of damage or breakage will exist to a greater degree particularly in those areas of the furnace which are directly adjacent to the burner. Breaking parts tend to fall on the burner at periods when the jet pipe is excessively stressed due to the formation of improper combustion. It has been found that portions of the pipe may burst or at least show hairline cracks. When such cracks appear, gas flow or leaks will develop between the furnace chamber and the jet pipe. Portions of burned flue gas may contaminate the atmosphere of the furnace chamber and as a result the furnace atomsphere will be adversely affected thus impeding the procedures which must be conducted in the furnace, such as, for example, carbonization, normalization, tempering, annealing, etc.

It is of further disadvantage that looseness in the coupling of the sectors of the flame breaker can cause considerable noise due to the flue gas which passes thereover.

In accordance with the present invention, it therefore becomes advantageous to provide a heating device which will operate with lower heat consumption and which will furthermore reduce the risk of breakage of the flame breaker and therefore reduce the risk of resulting damage to the jet pipe.

SUMMARY OF THE INVENTION

Briefly, the present invention may be described as an improvement in a heating device for the furnace chamber of an industrial furnace which has at least one burner heating element arranged in heat transfer relationship with the furnace chamber to provide heat for the chamber, said element having a generally elongated tubular configuration and including fuel burner means at one end thereof. The specific arrangement of the present invention comprises flame breaker means arranged to extend along portions of the length of said burner heating element between the fuel burner means and the opposite end of the heating element, said flame breaker means comprising a plurality of individual baffle plates spaced from each other axially along the length of said heating element.

Each baffle plate generally comprises a substantially circular disc with the baffle plates being divided into three groups. The first group closest the burner means may include a single baffle plate or a plurality of baffle plates which have a convex configuration facing toward the direction of the burner means. The plates of the second group are formed as generally planar discs and the third group plates are formed to include a concave side facing the burner means.

In a more specific aspect of the invention, the baffle plates are arranged to extend along a particular portion of the length of the overall jet tube or heating element. More specifically, the first group of baffle plates should extend axially between about 0.04 to 0.08 of the overall length of the jet pipe and preferably along 0.06 of the length thereof.

The second group of baffle plates should preferably extend across 0.17 to 0.21 of the overall length of the jet pipe, and preferably across 0.19 of the length thereof. Similarly, the third group, like the second group, should extend across 0.17 to 0.21 of the length of the jet pipe and preferably across 0.19 of the total length thereof.

In another specific aspect of the invention, each of the baffle plates of a given group may be formed with an identical diameter as the other baffle plates of the group. Alternatively in a further specific aspect of the invention, the diameters of the baffle plates may increase progressively from the baffle plate closest to the burner to the baffle plate farthest from the burner.

If each group of baffle plates is to be formed with identical diameters, then it is preferred if the diameters of the first group of baffle plates lying closest to the burner means are dimensioned within the range between 0.60 to 0.65 of the inside diameter of the jet pipe, with 0.63 being the preferred dimension. Similarly, the second group of baffle plates lying intermediate the first and the third group should, preferably, be dimensioned with a diameter of between 0.70 to 0.75 of the inside diameter of the jet pipe, with 0.72 being the preferred size. The third group of baffle plates, or the group lying furthest away from the burner means, should preferably be dimensioned with a diameter of between 0.78 to 0.84 of the inside diameter of the jet pipe, with 0.81 being the preferred dimension.

If the baffle plates are to be formed in accordance with the alternative embodiment wherein the diameter of the baffle plates increases progressively from the baffle plate closest to the burner to the baffle plate furthest therefrom, then it is preferred if the first baffle plate, that is the plate closest to the burner, have a diameter of about 0.63 of the inside diameter of the jet pipe with the largest baffle plate lying furthest from the burner having a diameter of about 0.81 of the inside diameter of the jet pipe.

With the construction of the burner arrangement in accordance with the present invention, better utilization of the heat generated in the burner by accumulation thereof in the jet pipe is developed. It has been found that exit temperatures at the exhaust of the jet pipe are considerably lower than in conventional devices. Energy savings in the order of more than 10% are considered achieveable. If the flame breaker of the invention is made from high temperature resistent steel, the risk of breakage is greatly reduced or eliminated. Additionally, noise is greatly reduced by the design of the present invention.

The first group of baffle plates of the invention, that is the group closest to the burner means, operate to shunt the heating gas generated by the burner radially outwardly in the direction of the walls of the jet pipe. The second group which consists of generally planar plates or discs, operates to produce turbulence extending at least over a partial range of the length of the jet pipe thereby causing better heat exchange between the jet pipe and the furnace chamber. The adjoining third group farthest from the burner means are formed to produce a baffle effect. With the design of the present invention the radiant heat generated by the burner means is conducted to the jet pipe so that the jet pipe becomes heated. The baffle plates serve to swirl the flue gas in order to tend to permit it to remain for a longer period of time in the jet pipe and thereby to provide a more intense utilization of the heat.

The baffle plates may be mounted in the jet pipe by a support member which generally comprises a slender elongated shaft extending downwardly from the end of the jet pipe and having the baffle plates mounted thereon to extend radially thereabout in axially spaced relationship. The elongated support member may have an end structured to engage the exhaust end of the jet pipe in a manner which will tend to automatically center the baffle plates mounted thereon so that an appropriate positioning within the jet pipe may be easily achieved. The particular design whereby the baffle plates support member may be made selfcentering is advantageous since should the flame breaker assembly be dislodged from its seated position for a brief period of time because of the combustion effects within the jet pipe, the assembly may be returned to its original position by the specific design of the mounting means.

In a specific consideration of the invention, at least the baffle plates adjacent or closest to the burner means should be made of high temperature-resistent steel.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
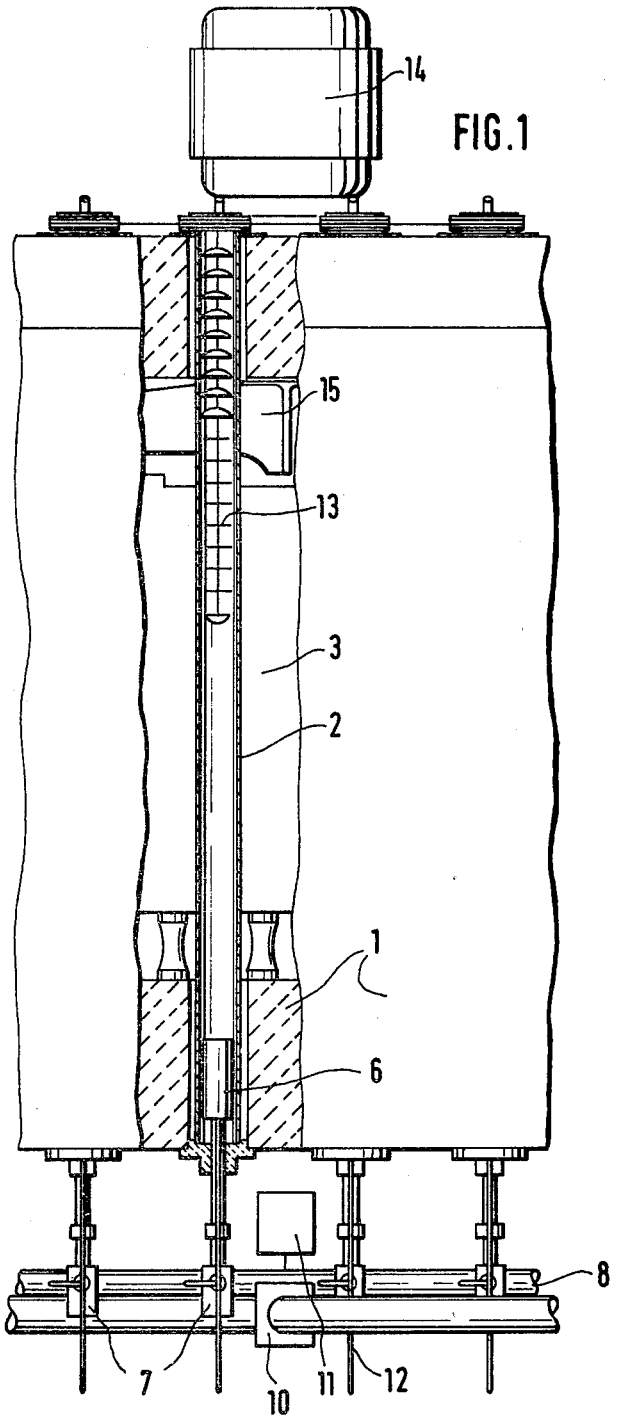
FIG. 1 is a side elevation partially broken away showing a furnace having a jet pipe emboding the arrangement of the present invention.

Referring now to the drawings wherein similar reference characters are used to refer to similar parts throughout the various figures thereof an industrial furnace which may embody the present invention consists substantially of refractory brickwork 1 which is designed as the outer casing of the furnace. Arranged along the sides of the furnace are a number of heating elements or jet pipes 2 which are arranged side by side about the furnace and which extend through a furnace chamber 3 to be heated thereby.

The jet pipes or heating elements 2 are sealed at their ends by sealing means 4 and 5 which operate to mount and seal the jet pipe 2 relative to the brickwork 1 at the inlet and outlet ends of the jet pipe 2.

In the lower end of the jet pipe 2 there is mounted a burner 6 which is supplied with fuel gas from a gas-air mixer. The burner 6 comprises burner means from which heated combustion gases may be delivered into the jet pipe 2. In the gas-air mixer for the burner 6, inlet gas pipes 8 and air pipes 9 controlled by a valve 10 are provided with a servomotor 11 operating to control the valve 10.

Figure 2:
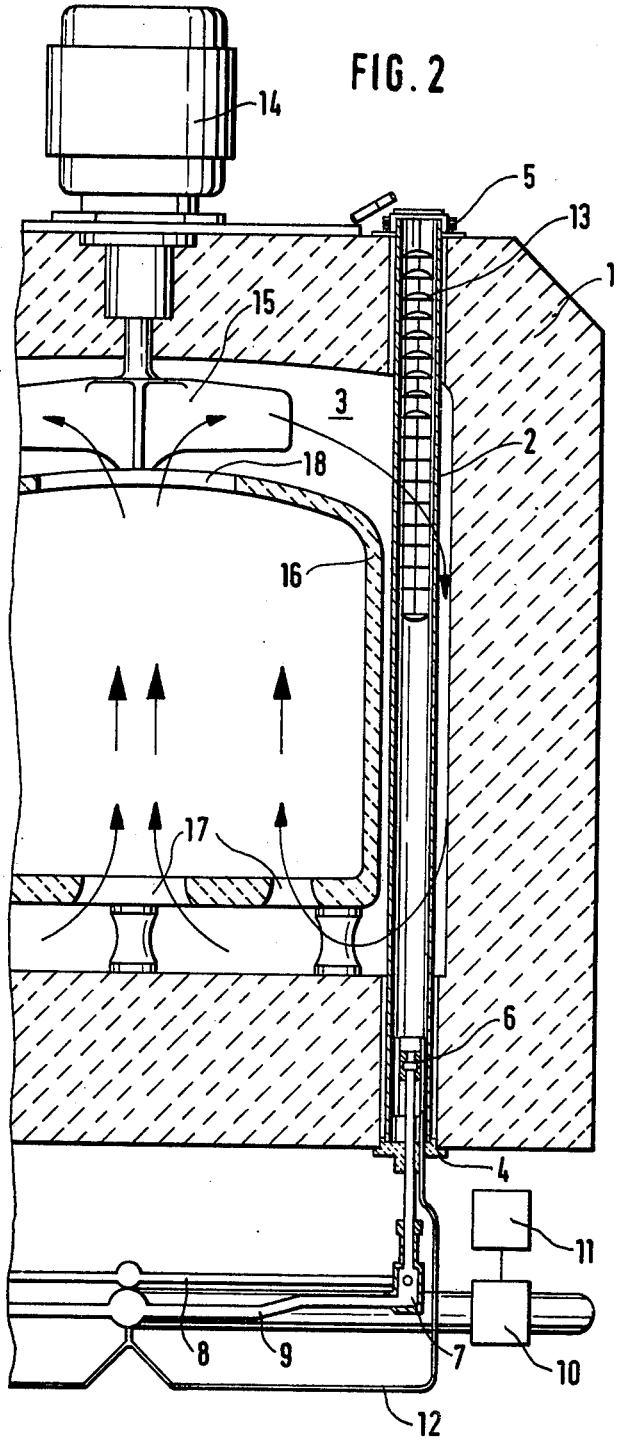
FIG. 2 is a partial sectional view of the furnace of FIG. 1 showing in greater detail pertinent portions thereof.

The number of jet pipes 2 which are provided in the furnace will depend upon the size of the furnace and the temperature which is required taking into consideration the working range thereof. Each jet pipe 2 includes a burner 6 supplied with fuel by a gas-air mixer 7. All of the gas-air mixers 7 are controlled by common gas-air pipes 8, 9 from the central valve 10. In the embodiment shown in particular in FIGS. 1 and 2, the burner 6 is cooled by an additional air pipe 12.

Secured in the upper range of the length of the jet pipe 2 remote from the end wherein the burner 6 is located there is provided a flame breaker assembly 13 which operates to insure better utilization of the heat generated from the heating element or jet pipe 2. The basic function of the flame breaker assembly 13 is to operate to effect more efficient utilization of the heat and, among other things, to prevent the heating gas from being exhausted from the jet pipe 2 in an overly rapid flow.

Blower means 15 located within the furnace chamber 3 is driven by a driving motor 14 mounted on the furnace top upon the brickwork 1. The blower 15 insures circulation of gases by propelling the gas from the bottom of the furnace compartment 16 past the jet pipes 2. Furnace compartment 16 receives therein workpieces to be treated within the furnace for example by heat treatment, and these workpieces are exposed to the protective gas flowing through the inlet opening 17 as well as through the outlet openings 18.

Figure 3:
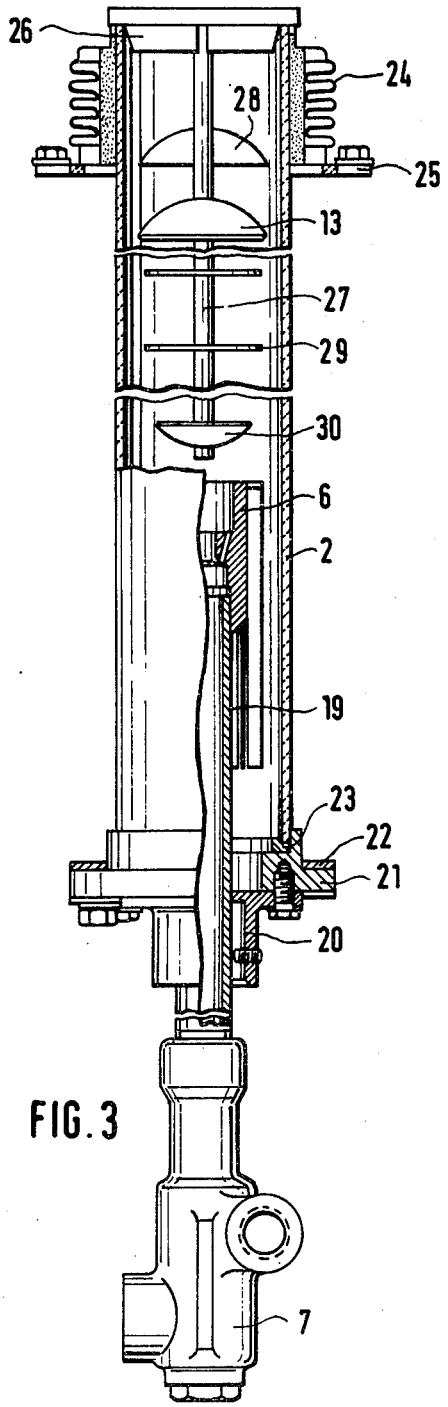
FIG. 3 is a sectional view partially broken away showing the jet pipe or heating device of FIG. 2 in greater detail on an enlarged scale.

FIG. 3 shows a single jet pipe 2 on an enlarged scale. The gas-air mixer 7 which supplies the burner 6 with fuel gas through the burner 19 is shown connected to the lower end. For sealing burner pipe 19 there is provided a flange 21 secured with a burner coupling 20. The flange 21 carries a seal 22 which seals it from the brickwork, and a seal 23 which seals it from the jet pipe 2. At its other end, the jet pipe 2 is surrounded by a metallic bellows 24 which seals the jet pipe on the upper side thereof from the brickwork 1 over its bellows joint 25.

Likewise, at the upper end of the jet pipe 2, there is mounted in a suspended fashion the flame breaker assembly 13. The assembly is mounted by means of a upper mount 26 which operates as a centering device. The upper mount 26 includes metallic plates extending radially within the jet pipe 2 and which may be arranged perpendicularly to each other. The plates of the mounting device 26 are beveled at their radially outer edges and thus if the flame breaker assembly is lifted upwardly relative to the jet pipe 2, it will be guided by its weight and by the beveled outer sides or edges of plates of the mounting device 26 back into a centered position within the jet pipe 2. Thus, should combustion within the jet pipe 2 cause dislodgement of the flame breaker assembly 13, the beveled edges of the mounting device 26 will insure appropriate repositioning of the flame breaker assembly 13 within the jet pipe 2.

Figure 4:
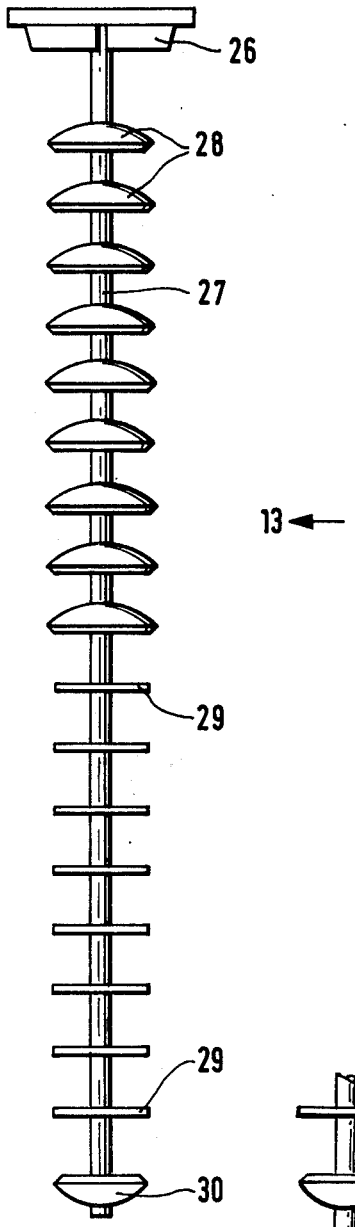
FIG. 4 is a side view of the flame breaker assembly of the present invention having a single baffle plate in the first group.
Figure 4A:
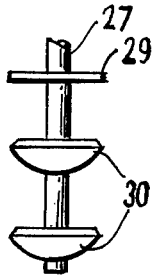
FIG. 4*a* shows the first group of baffle plates with a plurality of plates.

The flame breaker assembly 13 of the present invention is shown in greater detail in FIGS. 4 and 4*a*. The only difference between the embodiment of FIG. 4 and that of FIG. 4*a* is that in FIG. 4*a* a plurality of first group baffle plates 30 are shown whereas in FIG. 4 the embodiment consisting of only a single first group baffle plate 30 is depicted.

Extending downwardly from the self-centering mounting device 26 there is provided a support rod 27 having mounted thereon the baffle plates in accordance with the present invention.

More specifically, it will be seen particularly from FIG. 4, that three groups of baffle plates are provided. The first group comprises baffle plates 30 which are located closest to the burner 6. In accordance with the present invention, either a single baffle plate 30, as shown in FIG. 4, or a plurality of two or more baffle plates 30, as shown in FIG. 4*a*, may be included in the first group of baffle plates.

As will appear from FIG. 4, the baffle plates 30 are formed with a dish-shaped configuration and they are mounted upon the support rod 27 with a convex side facing downwardly or in the direction of the burner 6.

In the middle or second portion of the length of the baffle plate assembly 13 there are provided a second group of baffle plates 29. The baffle plates 29 essentially comprise circular planar discs centrically mounted on the support rod 27.

The third group of baffle plates comprise the baffle plates 28 each having a dish-shaped configuration with the convex side thereof facing upwardly or away from the burner 6 and with the opposite or concave side facing downwardly toward the second group of baffle plates 29 and toward the burner 6.

The first group of baffle plates 30 should extend along a length of the flame breaker assembly 13 which is commensurate with about 0.04 to 0.08 of the overall length of the jet pipe 2. Preferably, the first group of baffle plates 30 should occupy an axial length equal to about 0.06 of the overall length of the jet tube 2. The second group of baffle plates 29 are arranged to extend along the length of the baffle plate assembly 13 for a distance equivalent to about 0.17 to 0.21 of the overall length of the jet pipe 2. Preferably, the second group of baffle plates 29 should extend axially for a distance equivalent to about 0.19 of the overall length of the jet pipe 2.

The third group of baffle plates 28 are subject to similar axial length extension consideration as the second group of baffle plates. Thus, the plates 28 should extend along the axial length of the baffle plate assembly 13 for a distance equivalent to between 0.17 and 0.21 of the overall length of the jet pipe 2, and preferably over a distance equivalent to 0.19 of the overall jet pipe length.

With regard to the diameters of the various baffle plates, two possibilities are feasible within the concepts of the invention. First of all, the plates may progressively increase in diameter from the lowermost plate 30 closest to the burner 6 to the uppermost plate 28 farthest from the burner 6. If progressively increasing diameters are to be provided, then it is preferred that the lowermost baffle plate 30 have a diameter equivalent to 0.63 of the inside diameter of the jet pipe 2 with the uppermost baffle plate 28 farthest from the burner 6 having a diameter equivalent to about 0.81 of the inner diameter of the jet pipe 2.

Alternatively, each of the baffle plates of a particular group could be made with a diameter different from the diameter of the baffle plates of another group. In such an embodiment, each group of plates would have a different diameter with all of the plates of a given group being of the same diameter. If this embodiment of the invention is utilized then it is preferred that the first group of baffle plates 30 each have a diameter which is between about 0.60 to 0.65 of the inside diameter of the jet pipe 2 and preferably 0.63 of the inside jet pipe diameter.

The second group of baffle plates 29 would preferably be formed with a diameter equivalent to about 0.70 to 0.75 of the inside diameter of the jet pipe 2 with 0.72 being the preferred diameter.

In the case of the third group of baffle plates 28, the diameter of each plate should preferably be between about 0.78 and 0.84 of the inside jet pipe diameter and preferably 0.81 of the inside jet pipe diameter.

As previously indicated, the baffle plates arranged in accordance with the present invention operate to provide better utilization of the heat generated within the jet pipe 2. The specific orientation of each baffle plate of each group operates to provide a specific function toward the end that the flow of gas through the jet pipe 2 is conducted in a manner most beneficial to improved operating characteristics of the overall device while also enhancing the durability of the structure.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

What is claimed is:

1. In a heating device for the furnace chamber of an industrial furnace having at least one burner heating element arranged in heat transfer relationship with said furnace chamber to provide heat therefor, said element having a generally elongated tubular configuration and including fuel burner means at one end thereof, the improvement comprising flame breaker means arranged to extend along portions of the length of said burner heating element between said fuel burner means and the opposite end of said element, said flame breaker means consisting essentially of a plurality of individual baffle plates mounted within and spaced from said tubular configuration of said heating element and spaced axially along the length thereof, with baffle plates located closer to said fuel burner means being formed to extend transversely across the longitudinal direction of said heating element with smaller diametral dimension to provide greater spacing from the tubular heating element than baffle plates farther from said fuel burner means.

2. A heating device according to claim 1 wherein said baffle plates are arranged in three separate groups, with each group extending continuously over a portion of the length of said heating element, the baffle plates of each group being formed in a generally uniform configuration which is different from the configuration of the baffle plates of at least one of the other of said three groups.

3. A heating device according to claim 2 wherein said three groups of baffle plates are spaced different distances from said burner means, the first of said three groups being closest to said burner means, the third of said three groups being farthest from said burner means, and the second of said three groups being intermediate said first and third groups.

4. A burner according to claim 3 wherein said first group of said baffle plates is configured to shunt heating gas generated by said fuel burner means radially outwardly of said tubular configuration of said heating element.

5. A heating device according to claim 3 wherein said second of said groups of baffle plates is configured to produce turbulence in gas flowing through said heating element over at least a portion of the length of said jet pipe.

6. A heating device according to claim 3 wherein the third of said groups of baffle plates is configured to produce a baffle effect over the portion of the length of said heating element through which said third group extends.

7. A heating device according to claim 3 wherein said first group of baffle plates comprises at least one baffle plate having a dished configuration with a convex side, said convex side of said at least one baffle plate being directed toward said burner means.

8. A heating device according to claim 7 wherein said first group of baffle plates comprises a plurality of said dished baffle plates.

9. A heating device according to claim 3 wherein said second group of baffle plates consist essentially of a plurality of planar discs.

10. A heating device according to claim 3 wherein said third group of baffle plates comprises a plurality of plates having a dished configuration with a concave side, said concave side of said plates being arranged to face in the direction of said burner means.

11. A heating device according to claim 1 wherein said baffle plates have a generally circular configuration, said flame breaker means being comprised of plates having diameters which progressively increase as the spacing of said plates from said burner means increases.

12. A heating device according to claim 11 wherein the baffle plate of said flame breaker means closest to said burner means has the smallest diameter of all of the baffle plates in said flame breaker means and wherein the baffle plate farthest from said burner means has the largest diameter.

13. A heating device according to claim 3 wherein each of the baffle plates of said three groups of baffle plates are formed with a generally circular configuration and wherein each of the plates of said first group have the same diameter, each of the plates of said second group have the same diameter and each of the plates of said third group have the same diameter with the diameters of the plates of each group being different from the diameter of the plates of another group.

14. A heating device according to claim 13 wherein said heating element comprises an inner diameter within which said flame breaker means is located and wherein the baffle plates of said first group are formed with a diameter which is between about 0.60 and 0.65 of the inner diameter of said heating element.

15. A heating device according to claim 14 wherein the diameter of said first group of baffle plates is 0.63 of the inner diameter of said heating element.

16. A heating device according to claim 3 wherein said heating element comprises an inner diameter within which said flame breaker means is located, and wherein said second group of baffle plates is formed with a diameter which is between about 0.70 and 0.75 of the inner diameter of said heating element.

17. A heating device according to claim 16 wherein the diameter of said second group of baffle plates is 0.72 of the inner diameter of said heating element.

18. A heating device according to claim 3 wherein said heating element comprises an inner diameter within which said flame breaker means is located and wherein said third group of baffle plates are formed with a generally circular configuration having a diameter which is between about 0.78 and 0.84 of the inner diameter of said heating element.

19. A heating device according to claim 18 wherein the diameter of said third group of baffle plates is 0.81 of the inner diameter of said heating element.

20. A heating device according to claim 3 wherein said heating element has an overall length which extends generally between said fuel burner means in the opposite end of said heating element, and wherein said first group of baffle plates occupy an axial distance along said flame breaker means equivalent to about 0.04 and 0.08 of the overall length of said heating element.

21. A heating device according to claim 20 wherein said first group of baffle plates extends axially a distance equivalent to 0.06 of the overall length of said heating element.

22. A heating device according to claim 3 wherein said heating comprises an overall length extending between said fuel burner means and the opposite end of said heating element, and wherein said second group of baffle plates extends for a distance along the length of said flame breaker means equivalent to about 0.17 and 0.21 of the overall length of said heating element.

23. A heating device according to claim 22 wherein said second group of baffle plates extend axially for a distance equivalent to 0.19 of the overall length of said heating element.

24. A heating device according to claim 3 wherein said heating element comprises an overall length which extends between said fuel burner means and the opposite end of said heating element, and wherein said third group of baffle plates extends axially along the length of said flame breaker means a distance equivalent to between 0.17 and 0.21 of the overall length of said heating element.

25. A heating device according to claim 24 wherein said third group of baffle plates extends axially a distance equivalent to 0.19 of the overall length of said heating element.

26. A heating device according to claim 1 wherein said elongated tubular configuration of said heating element extends in a generally upright vertical direction, said heating device further including support means for supporting said baffle plates to extend in a generally vertically aligned configuration depending downwardly from the upper end of said heating element, said mounting means for said baffle plates including beveled surfaces engaging the sides of said heating element to insure that said flame breaker means will lie along a path which extends generally centrally within said heating element.

27. A heating device according to claim 12 wherein said heating element comprises an inner diameter within which said flame breaker means is located, and wherein said baffle plate closest to said burner means has a diameter which is about 0.63 of said inner diameter with the baffle plate farthest from said burner means having a diameter equivalent to about 0.81 of said inner diameter.

28. A heating device according to claim 1 wherein baffle plates located an intermediate distance from said fuel burner means are formed with transversely extending diametral dimensions intermediate the diametral dimensions of said closer and further baffle plates.

* * * * *